US008403648B2

(12) United States Patent
Boscarato

(10) Patent No.: US 8,403,648 B2
(45) Date of Patent: Mar. 26, 2013

(54) COMPRESSOR CONTROL DEVICE AND METHOD FOR CONTROLLING A COMPRESSOR

(75) Inventor: Albert Boscarato, Prague (CZ)

(73) Assignee: STMicroelectronics Design and Application s.r.o., Prague (CZ)

( * ) Notice: Subject to any disclaimer, the term of this patent is extended or adjusted under 35 U.S.C. 154(b) by 1408 days.

(21) Appl. No.: 12/016,287

(22) Filed: Jan. 18, 2008

(65) Prior Publication Data

US 2008/0175718 A1 Jul. 24, 2008

(30) Foreign Application Priority Data

Jan. 19, 2007 (EP) ..... 07100790

(51) Int. Cl.
*F04B 49/06* (2006.01)

(52) U.S. Cl. .. 417/32; 417/18; 318/400.08; 318/400.21; 388/934

(58) Field of Classification Search ..... 417/18, 417/32; 318/400.08, 400.21, 471–473; 62/227; 388/934
See application file for complete search history.

(56) References Cited

U.S. PATENT DOCUMENTS

| | | | | |
|---|---|---|---|---|
| 3,278,111 | A | 10/1966 | Parker | |
| 4,083,235 | A | 4/1978 | Gallant | |
| 4,114,077 | A * | 9/1978 | Oates et al. | 318/473 |
| 4,467,260 | A | 8/1984 | Mallick, Jr. et al. | |
| 4,660,247 | A | 4/1987 | Frohbieter et al. | |
| 4,757,242 | A * | 7/1988 | Prather | 318/473 |
| 5,491,978 | A * | 2/1996 | Young et al. | 62/126 |
| 6,495,981 | B2 | 12/2002 | Romanowich et al. | |
| 6,520,279 | B2 * | 2/2003 | Fukumoto et al. | 180/446 |
| 6,807,941 | B2 | 10/2004 | Galtier | |
| 2004/0079333 | A1 | 4/2004 | Galtier | |
| 2005/0133855 | A1 * | 6/2005 | Graf | 257/327 |

FOREIGN PATENT DOCUMENTS

| | | | |
|---|---|---|---|
| EP | 0 432 085 | A2 | 6/1991 |
| EP | 0 588 633 | A1 | 3/1994 |
| GB | 1 402 905 | | 8/1975 |
| GB | 2 136 217 | A | 9/1984 |
| JP | 60201037 | A2 * | 10/1985 |
| JP | 08 40053 | A | 2/1996 |
| JP | 2001-73990 | | 3/2001 |
| JP | 2001-339918 | | 12/2001 |

OTHER PUBLICATIONS

European Search Report from corresponding French Application No. 0 432 085 A2 filed Jan. 17, 2007.
Gonthier, L. et al. "ST6200C Software Description for Cooling Thermostat Application" AN1353 Application Note, pp. 1-14, Apr. 2001.
Mackay, W. et al. "Compressor Induction Motor Stall and Rotation Detection Using Microcontrollers" Freescale Semiconductor, Inc., AN2149, pp. 1-36, 2004.

* cited by examiner

*Primary Examiner* — Charles Freay
*Assistant Examiner* — Patrick Hamo
(74) *Attorney, Agent, or Firm* — Wolf, Greenfield & Sacks, P.C.

(57) ABSTRACT

A compressor control device includes a driving circuit, for controllably supplying a coil of an electric motor of a compressor. A temperature sensor is thermally coupled to the driving circuit and provides a temperature sensing signal correlated to a temperature in the driving circuit. A control stage, coupled to the driving circuit and to the temperature sensor, selectively prevents the driving circuit from supplying the coil, in response to a minimum temperature increment being detected by the temperature sensor within a pre-determined control time window.

16 Claims, 5 Drawing Sheets

COMPRESSOR CONTROL DEVICE AND METHOD FOR CONTROLLING A COMPRESSOR

BACKGROUND OF THE INVENTION

1. Field of the Invention

The present invention relates to a compressor control device and to a method for controlling a compressor.

2. Discussion of the Related Art

Household and small size industrial appliances, such as refrigerators, freezers or air conditioning systems, include systems that are provided with a compressor driven by an electric motor. A control device, normally based on a switching circuit, controls operation of the motor, and selectively turns it on and off, according to certain requirements.

Under some circumstances, it may happen that the compressor is stalled when the control circuit intervenes and attempts to start the motor. In this case, the control circuit is subject to risk of damage, due to overcurrents that may occur.

Several solutions have been proposed so far, in order to reduce risks of damage and high power consumption associated with stall conditions.

According to a first known solution, the condition of a stalled compressor is detected by means of a thermo-mechanical switch, that breaks the current supply within a given time, if the current remains high. Response of thermo-mechanical switches, however, is not sufficiently fast and protection may fail. Moreover, even in case of timely response, solutions based on thermo-mechanical switches suffer from considerable power consumption, because a constant current, that is several times greater than nominal operative currents, continues flowing until switches are opened.

Another known solution consists of coupling a resistor in series with the control device, in order to sense the current supplied to the electric motor of the compressor. Safety measures are activated when sensed current is higher than a predetermined current threshold. Use of a series resistor affords timely reaction to compressor stall conditions, but also entails higher manufacturing costs, because the resistor has to be large both as to power requirements and to size. In addition, when the compressor is not stalled, the large series resistor seriously impairs power consumption.

Also other control circuits have been proposed, which are configured to detect phase shift between windings of the compressor motor. However, these control circuits need to include special processing units and dedicated components to sense and compare phases, which results in increased cost and size of the devices.

SUMMARY OF THE INVENTION

An object of the invention is to provide a compressor control device and a method for controlling a compressor that overcomes at least the above described drawbacks.

According to one embodiment of the present invention, a compressor control device is provided comprising a compressor control device, comprising:

a driving circuit, for controllably supplying a coil of an electric motor of a compressor;

a temperature sensor, thermally coupled to the driving circuit for providing a temperature sensing signal correlated to a temperature in the driving circuit; and a control stage, coupled to the driving circuit and to the temperature sensor, for selectively preventing the driving circuit from supplying the coil, in response to a minimum temperature increment being detected by the temperature sensor within a pre-determined control time window.

According to another embodiment of the present invention, a method for controlling a compressor comprising a method for controlling a compressor, comprising the step of:

controllably supplying a coil of an electric motor of the compressor through a driving circuit;

providing a temperature sensing signal correlated to a temperature in the driving circuit; and preventing the driving circuit from supplying the coil, in response to a minimum temperature increment being detected within a pre-determined control time window.

BRIEF DESCRIPTION OF THE DRAWINGS

For the understanding of the present invention, preferred embodiments thereof are now described, purely as non-limitative examples, with reference to the enclosed drawings, wherein.

DETAILED DESCRIPTION

Figure 1:
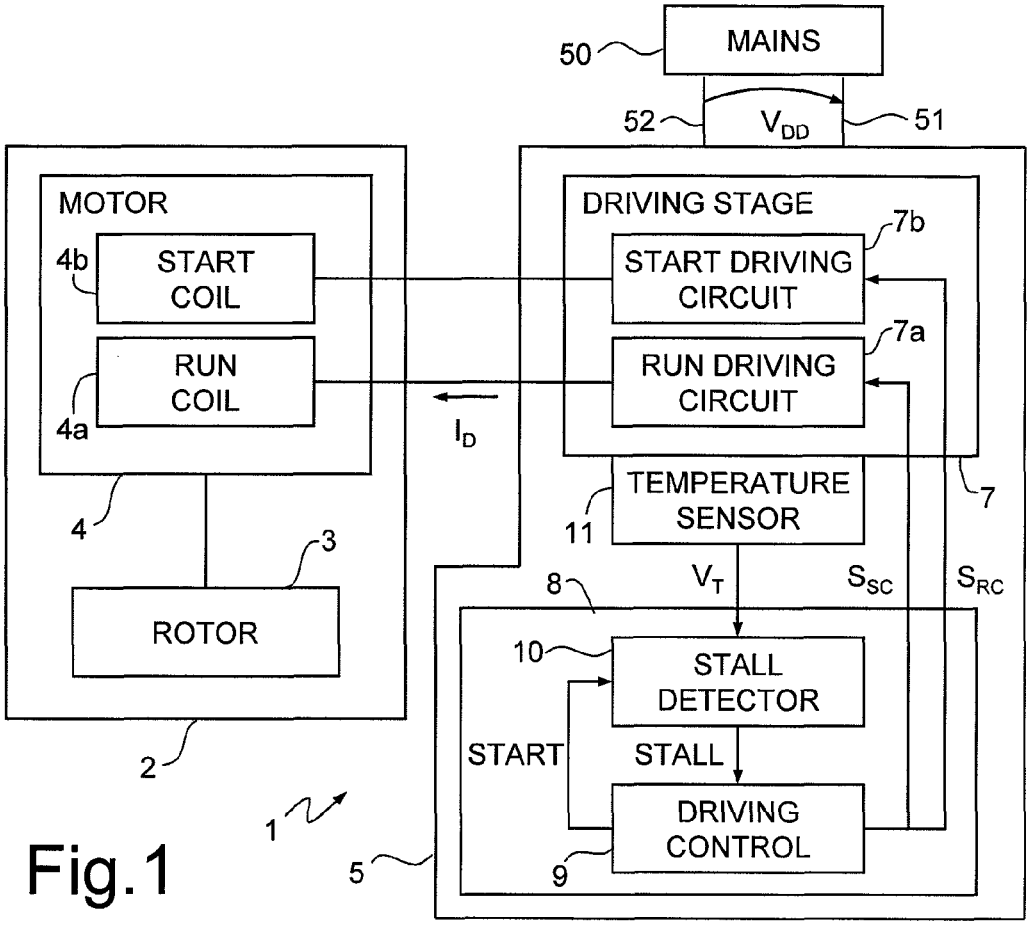
FIG. 1 is a simplified block diagram of a household appliance incorporating a control device according to one embodiment of the present invention.

As shown in FIG. 1, a household appliance, here a refrigerator 1, comprises a compressor 2, equipped with a rotor 3 that is driven by an electric motor 4, and a control device 5, for controlling operation of the electric motor 4.

The electric motor 4 comprises a run coil 4*a* and a start coil 4*b*, that are simultaneously activated to start the compressor 2. When a compressor start step ends, only the run coil 4*a* is operated, while the start coil 4*b* is no longer conducting.

The control device 5 includes a driving stage 7, a control stage 8 and a temperature sensor 11. Moreover, the control device 5 receives an AC supply voltage $V_{DD}$ from external mains 50, via a supply phase line 51 and a supply neutral line 52.

In the present embodiment, the control stage 8 is based on a digital processing unit and comprises a driving control module 9 and a stall detector module 10.

The driving stage 7 comprises a run driving circuit 7*a* and a start driving circuit 7*b*, respectively coupled to the run coil 4*a* and the start coil 4*b*. The run driving circuit 7*a* and the start driving circuit 7*b* are operated by the driving control module 9 for controllably supplying the electric motor 4 during a start step and a normal running step. In particular, the run coil 4*a* of the electric motor 4 receives a driving current $I_D$ from the run driving circuit 7*a*. For the purpose of controlling the driving current $I_D$, the driving control module 9 receives a plurality of status signals (here not shown), that are processed in a conventional manner to produce run control pulses $S_{RC}$ for the run driving circuit 7*a*. Similarly, the driving control module 9 produces start control pulses $S_{SC}$ for the start driving circuit 7*b*. In addition, the driving control module 9 sends start pulses START to the stall detector module 10 when activation of the compressor 2 is requested.

The temperature sensor 11 is thermally coupled to the run driving circuit 7*a*, as explained later on, and provides the stall detector module 10 with a sensing voltage $V_T$, that is correlated to temperature in the run driving circuit 7*a*.

The stall detector module 10 supplies the driving control module 9 with a compressor stall signal STALL, based on the sensing voltage $V_T$ (operation of the stall detector module 10 will be explained in greater detail later on). In particular, the compressor stall signal STALL has a first value (e.g. a low logic value), to indicate normal operation of the compressor 2, and a second value (e.g. a high logic value), to indicate a stall condition of the compressor 2.

In response to the second value of the compressor stall signal STALL, the driving control module 9 prevents the run driving circuit 7*a* from supplying the run coil 4*a*, so that no current is drawn by the electric motor 4 and the compressor 2 is immediately halted.

Figure 2:
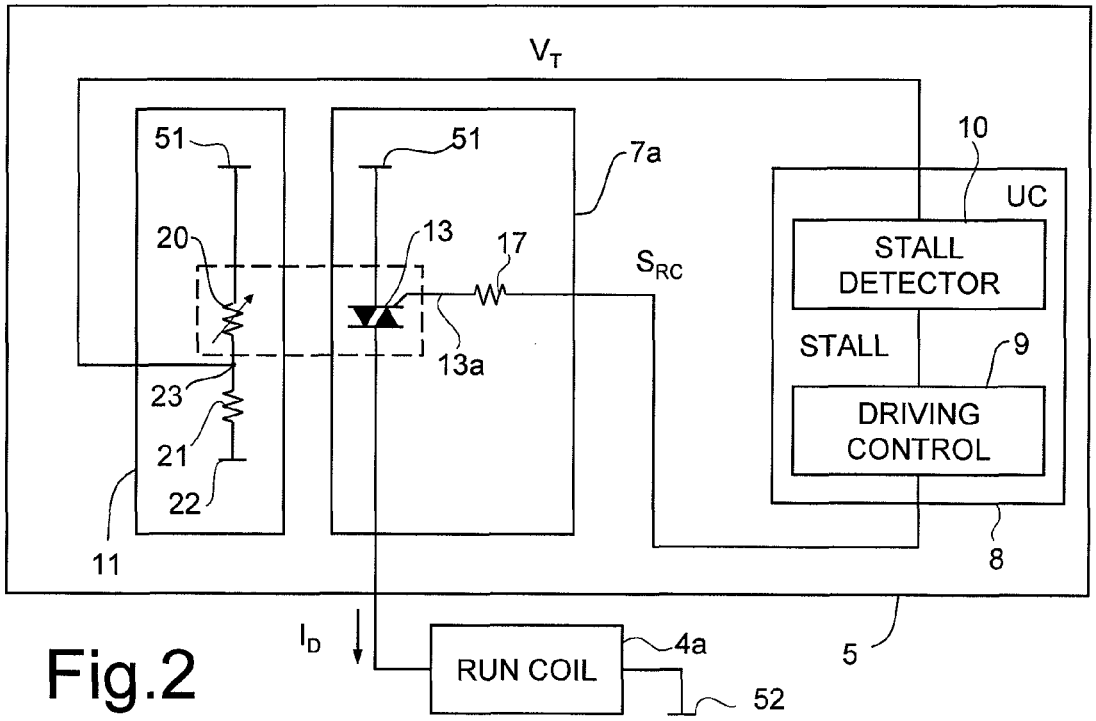
FIG. 2 is a hybrid circuit and block diagram of a portion of the control device of FIG. 1.

A portion of the start driving circuit 7*a* and the temperature sensor 11 is illustrated in greater detail in FIG. 2.

The run driving circuit 7*a* comprises a switching component, that in the embodiment herein described is a TRIAC 13. A control terminal 13*a* of the TRIAC 13 is connected to a terminal of the driving control module 9 through a resistor 17, for receiving the control pulses $S_{RC}$.

In response to the control pulses $S_{RC}$, the run driving circuit 7*a* triggers the TRIAC 13 for activation. In a known manner, the driving control module 9 sends the control pulses $S_{RC}$ to the run driving circuit 7*a* for providing switching control of the driving current $I_D$, by timing activation of the TRIAC 13 according to predetermined requirements.

Figure 3:
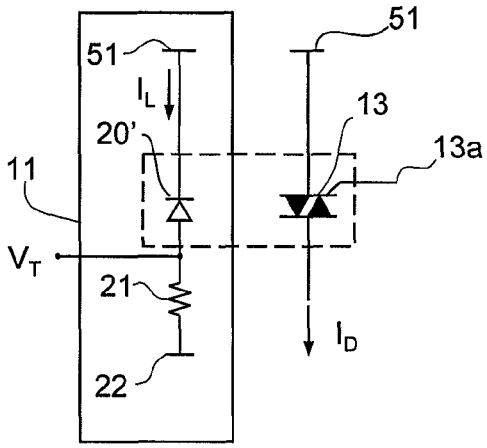
FIG. 3 shows a variant of a portion of the control device of FIG. 2.

The temperature sensor 11 includes a temperature sensitive element, namely a thermistor 20, and a third resistor 21, mutually connected to form a voltage divider between the supply phase line 51 and the ground line 22. The temperature sensor 11 is arranged as close as possible to the TRIAC 13, so that the TRIAC 13 and the thermistor 20 are thermally coupled. A sense node 23, that is common to the thermistor 20 and to the third resistor 21, is connected to an input terminal of the stall detector module 10 and provides the sensing voltage $V_T$, that is correlated to the temperature of the TRIAC 13. According to another embodiment (see FIG. 3), the temperature sensitive element is a reverse biased sensing diode 20', a leakage current $I_L$ whereof is dependent on temperature.

In response to the first value of the compressor stall signal STALL, the driving control module 9 normally operates the driving stage 7 to supply the electric motor 4 and start the compressor 2, as explained above.

If the stall detector module 10 determines that the rotor 3 is stalled, the compressor stall signal STALL switches to the second value and the driving control module 9 turns off the driving stage 7, so that no current is supplied to the electric motor 4 and the compressor 2 is immediately halted.

The stall detector module 10 is configured to convert the sensing voltage $V_T$ into a TRIAC temperature T, by conventional processing, and to monitor the increments of the TRIAC temperature T in a predetermined control time window $\Delta\tau$ from a start time $\Delta_0$ when the electric motor 4 is started. If the TRIAC temperature T shows a pre-determined minimum temperature increment $\Delta T$ within the control time window $\Delta\tau$, the compressor stall signal STALL is set to the second value to prevent the run driving circuit 7*a* from supplying the run coil 4*a* of the electric motor 4.

Figure 4:
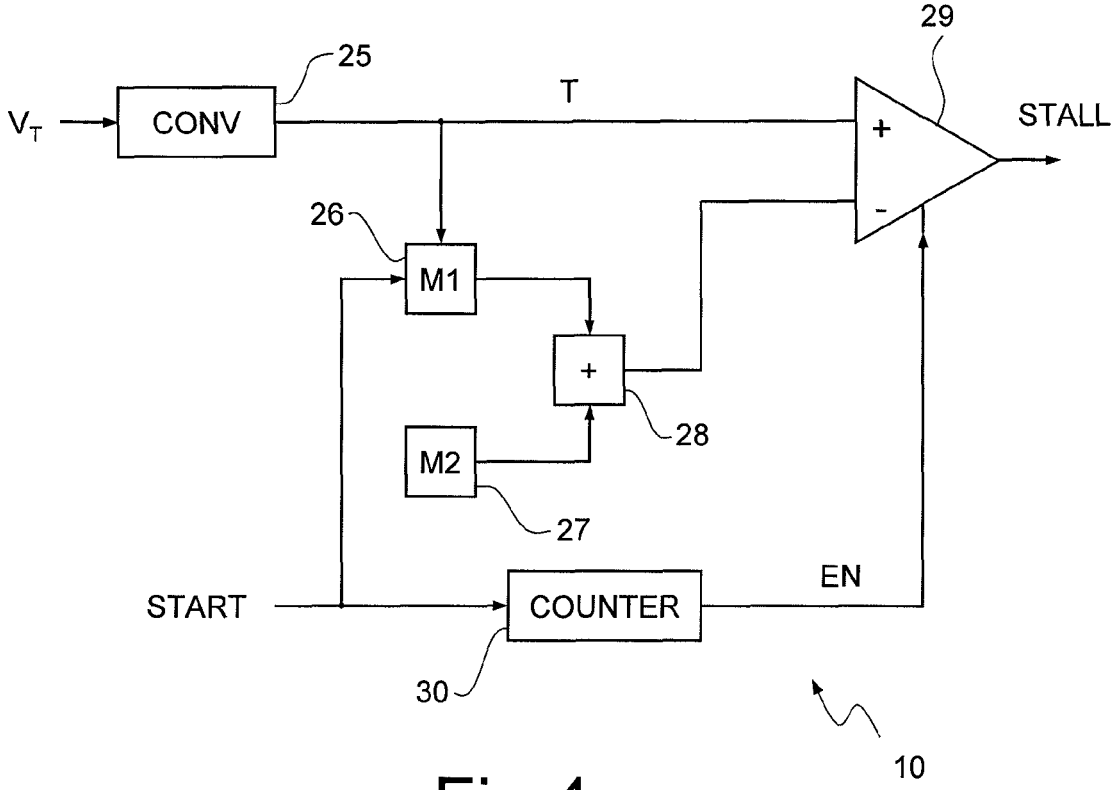
FIG. 4 is a more detailed block diagram of a particular of FIG. 2.

A non limiting example of the structure of the stall detector module 10 will be now described in further detail, with reference to FIG. 4. The stall detector module 10 comprises a conversion module 25, a first and a second memory element 26, 27, feeding into an adder module 28, a comparator 29 and a counter module 30.

The conversion module 25 receives the analog sensing voltage $V_T$ and, by conventional processing, converts it into a TRIAC temperature T, in a digital format.

The first memory element 26 receives the TRIAC temperature T from the conversion module 25 and is configured for storing a current value thereof on receipt of a start pulse START from the driving control module 9. The second memory element 27 stores the pre-determined minimum temperature increment $\Delta T$.

The adder module 28 is configured for adding the contents of the first and a second memory element 26, 27 and for supplying the result to a first (inverting) input of the comparator 29. A second (non inverting) input of the comparator 29 receives the current value of TRIAC temperature T from the conversion module 25. The comparator 28 has also an enable input, coupled to the counter module 30 for receiving an enable signal EN. The enable signal EN has an enable value, that enables the comparator 29 to switch, and a disable value, that prevents the comparator 29 from switching The output of the comparator 29 provides the compressor stall signal STALL.

The counter module 30 is activated by start pulses START provided by the driving control module 9 and supplies the enable signal EN. In particular, the enable value of the enable signal EN is provided as long as the content of the counter module 30 indicates that a predetermined control time window $\Delta\tau$ has not yet expired from activation. The disable value of the enable signal EN is provided otherwise.

Operation of the stall detector module 10 is the following.

When the electric motor 4 is started, the driving control module 9 accordingly notifies the stall detector module 10 by a start pulse START. In response to a start pulse START, the stall detector module 10 stores an initial value of the TRIAC temperature T in the first memory element 26. The first input of the comparator 29 therefore receives a higher temperature limit that corresponds to the minimum temperature increment $\Delta T$ over the TRIAC temperature T value stored in the first memory element 26. Moreover, the counter module 30 enables the comparator 29 to switch.

If the TRIAC temperature T exceeds the higher temperature limit before the control time window $\Delta\tau$ expires, the comparator 29 switches and the compressor stall signal STALL goes to the second value, thereby halting the compressor 2. Otherwise, when the control time window $\Delta\tau$ ends, the comparator 29 is disabled by the counter module 30 and the stall signal STALL cannot switch, so that the compressor 2 is normally operated.

Figure 5:
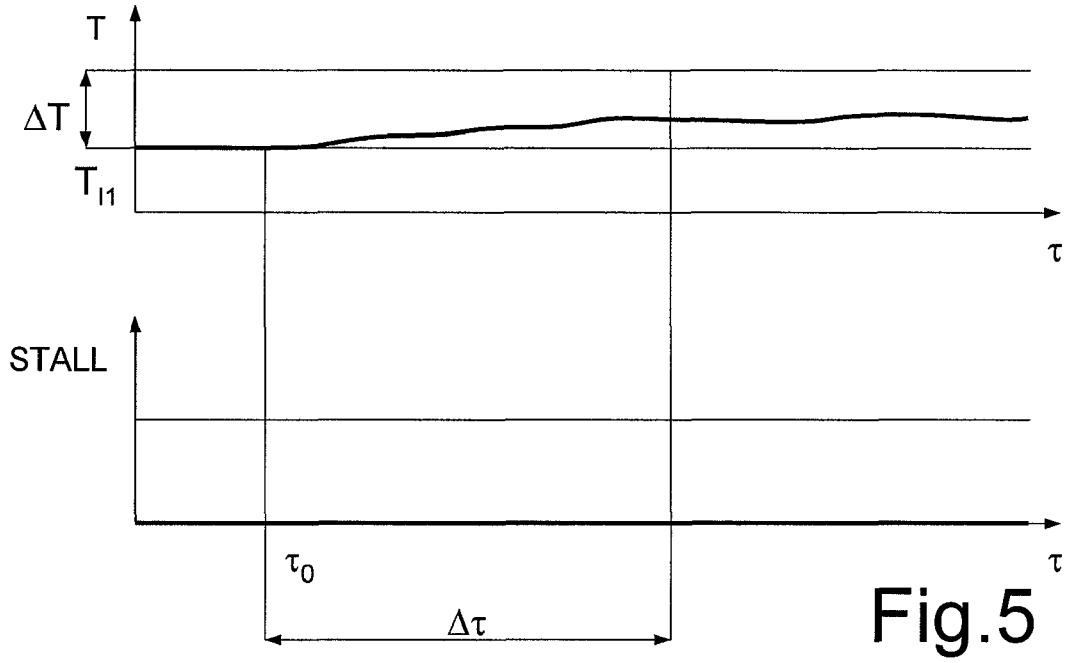
FIG. 5 shows plots of quantities relating to the control device of FIG. 1, in a first operating condition.

FIG. 5 shows a diagram of the TRIAC temperature T when the compressor 2 is started and the rotor 4 is not stalled. Before starting, the TRIAC temperature T has a first initial temperature value $T_{I1}$. When the electric motor 4 is started (start time $\tau_0$), the TRIAC temperature T increases as a function of the driving current $I_D$. Since the compressor 2 is normally operating, the driving current $I_D$ remains within a nominal current range and does not cause overheating of the TRIAC 13. In this condition, the compressor stall signal STALL is maintained at the first value (low, compressor not stalled).

Figure 6:
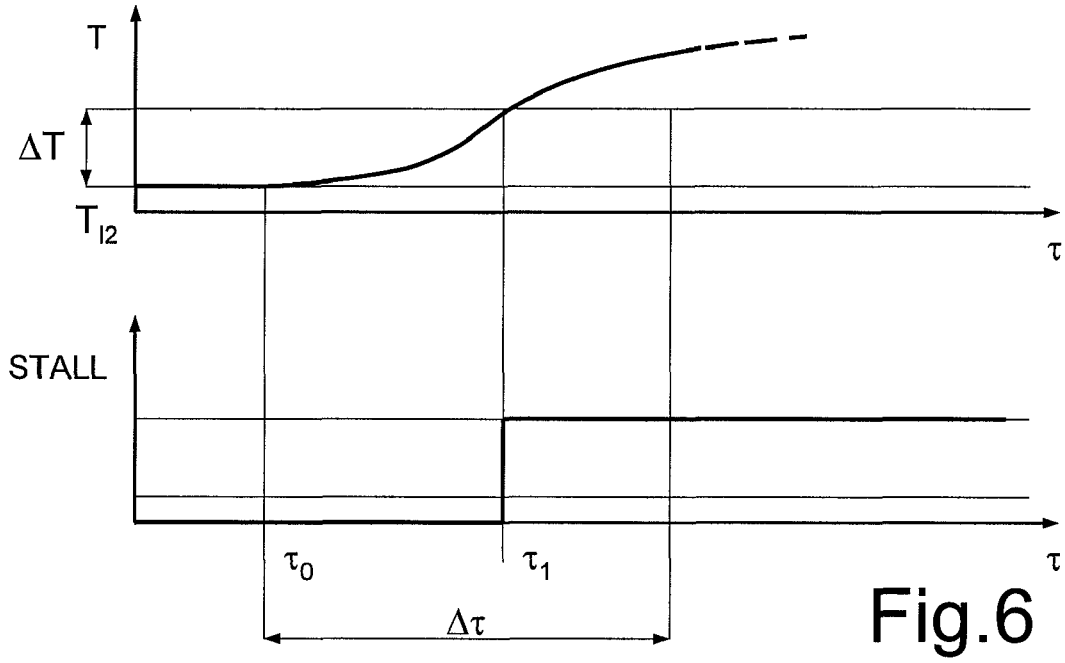
FIG. 6 shows plots of quantities relating to the control device of FIG. 1, in a second operating condition.

When the driving control module 9 tries to start the compressor 2 from a stalled condition (FIG. 6), the driving current $I_D$ soon exceeds the nominal current range by several times and causes overheating of the TRIAC 13. TRIAC temperature T rapidly increases from a second initial temperature value $T_{I2}$. If the minimum temperature increment $\Delta T$ is detected by the temperature sensor 11 before the control time window $\Delta\tau$ expires, the stall detector module 10 sets the compressor stall signal STALL at the second value (compressor 2 stalled). In the plot of FIG. 6, the TRIAC temperature T shows the minimum temperature increment $\Delta T$ at time $\tau_1$. In response to the compressor stall signal STALL switching to the second value, the driving control module 9 turns off the driving stage 7 to halt the motor 4, thereby preventing overheating and possible damage of the TRIAC 13.

It should be noted that the initial temperature values essentially depend on environmental conditions, because initially the compressor is not running and no current is supplied. Thus, the first and second initial temperature values $T_{I1}$, $T_{I2}$ do not need to be equal. The stall detector module 10, however, reacts when a minimum temperature increment $\Delta T$ is reached over the temperature value the TRIAC 13 had at the time the motor 4 was started. In other words, the stall detector module 10 responds to heating speed of the TRIAC 13.

Figure 7:
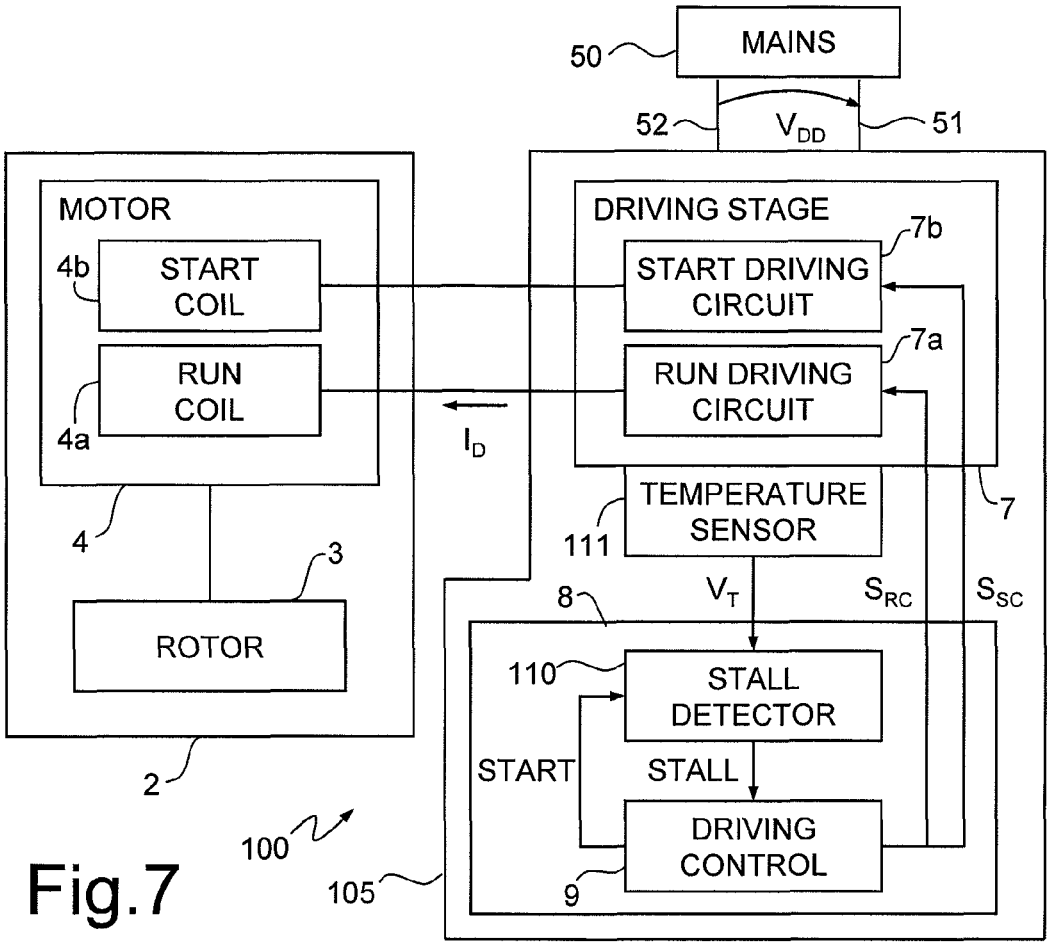
FIG. 7 is a simplified block diagram of a household appliance incorporating a control device according to another embodiment of the present invention.
Figure 8:
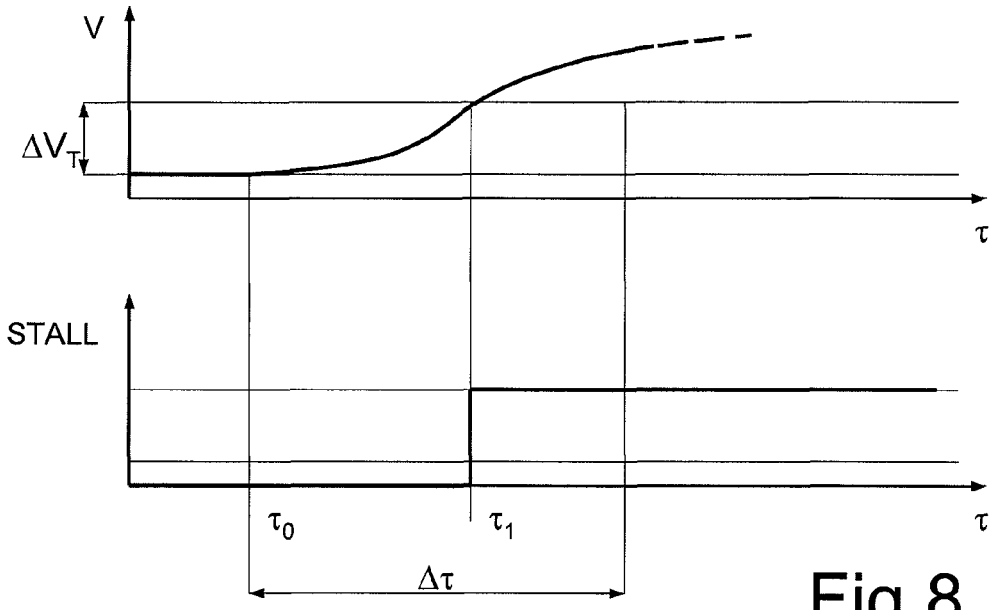
FIG. 8 shows plots of quantities relating to the control device of FIG. 7.

According to a second embodiment, illustrated in FIGS. 7 and 8, a household appliance, here a refrigerator 100 is equipped with a control device 105, that includes a stall detector module 110. Other parts are the same as already described. The stall detector module 110 determines the compressor stall signal STALL directly on the basis of the sensing voltage $V_T$, by comparing the voltage increment in the control time window $\Delta\tau$ to an appropriate minimum voltage increment $\Delta V_T$.

Figure 9:
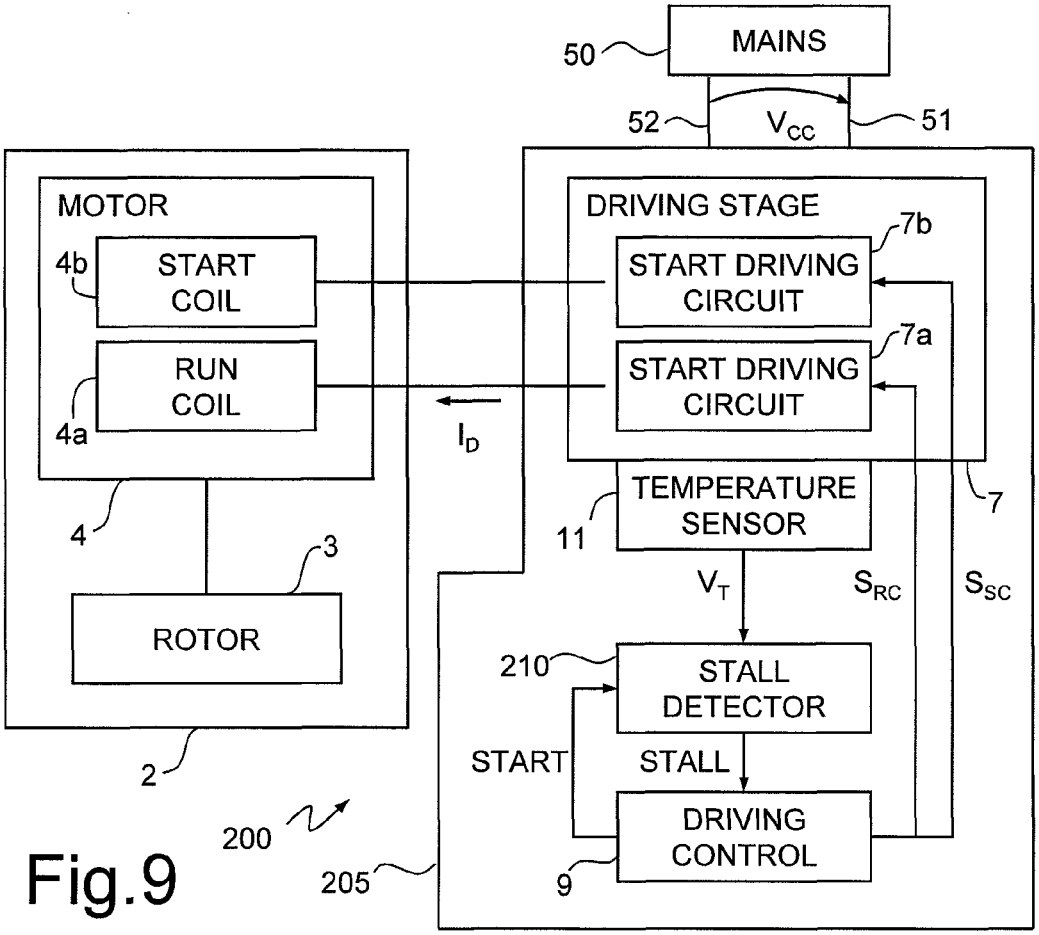
FIG. 9 is a simplified block diagram of a household appliance incorporating a control device according to another embodiment of the present invention.
Figure 10:
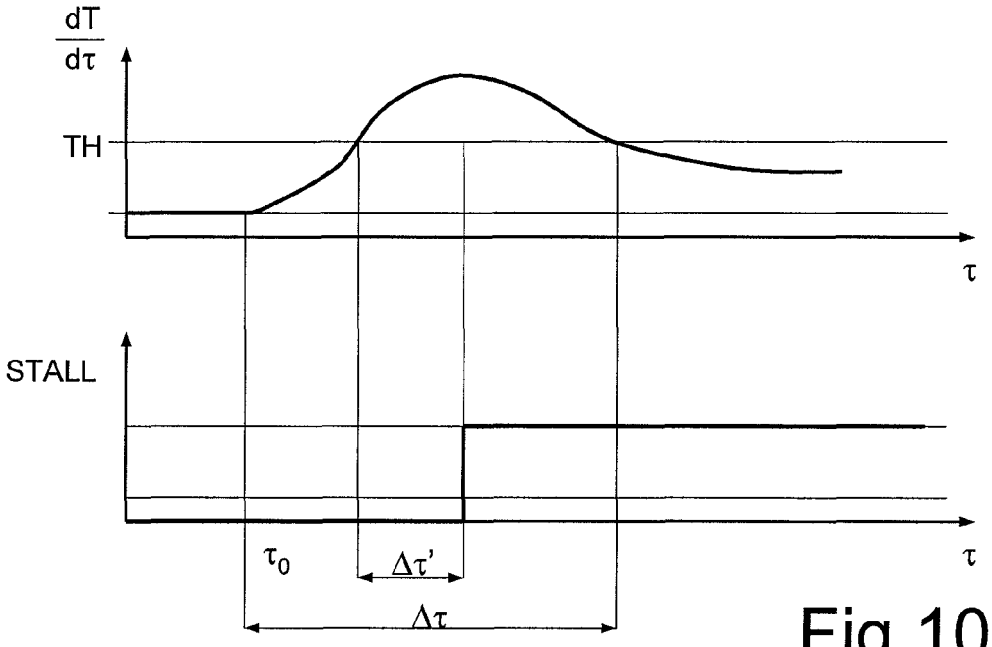
FIG. 10 shows plots of quantities relating to the control device of FIG. 9.

FIGS. 9 and 10 show a third embodiment of the invention. A household appliance, in this case an air conditioning system 200, is equipped with a control device 205 that includes a stall detector module 210. In this case, the stall detector module 210 is an analog circuit, configured to produce the compressor stall signal STALL in a format that is immediately usable by the driving control module 9. Other parts are the same as already described. Based on the sensing voltage $V_T$ provided by the temperature sensor 211, the stall detector module 210 calculates the derivative $dT/d\tau$ of the TRIAC temperature T and sets the compressor stall signal STALL at the second value (compressor stalled) if, before the time window $\Delta\tau$ expires, the derivative $dT/d\tau$ exceeds a pre-determined threshold TH for a given period $\Delta\tau'$. Of course, this condition corresponds to the TRIAC temperature T showing a minimum pre-determined increment over the initial temperature value it had at the start time $\tau_0$, when the compressor 2 is started.

The control circuit according to the present invention advantageously responds to temperature variations of the switching component included in the run driving control circuit 7*a*. Since the switching component is subject to the highest risk of damages caused by overheating, compared to other components, effective protection is achieved. Speed of response is high, because the temperature sensitive element may be easily arranged in the vicinity of the switching component to provide good thermal coupling.

The stall detector module and the control driving module respond to steep temperature gradients, rather than to temperature thresholds. Accordingly, speed of response is not appreciably affected by environmental conditions (namely external temperature). In particular, occurrence of a rotor stall condition always involves large driving currents and rapid heating of the switching component, independent of the initial temperature of the control device. Hence, the time required for the stall detector module to react is approximately the same even starting from considerably different initial temperature conditions (e.g. both in winter and in summer). Greater reliability and precision are thus achieved.

The control device according to the invention is simple and compact. In particular, a conventional processing unit suitably configured may be used to provide the stall detector module and the driving control module. No special processing unit terminals or dedicated circuits are required, except the temperature sensor.

Finally, it is clear that numerous modifications and variations may be made to the device and the method described and illustrated herein, all falling within the scope of the invention, as defined in the attached claims.

What is claimed is:

1. A compressor control device, comprising:

a driving circuit, for controllably supplying a coil of an electric motor of a compressor;

a temperature sensor, thermally coupled to the driving circuit for providing a temperature sensing signal correlated to a temperature in the driving circuit; and a control stage, coupled to the driving circuit and to the temperature sensor, for selectively preventing the driving circuit from supplying the coil, in response to a minimum temperature increment being detected by the temperature sensor within a pre-determined control time window.

2. A compressor control device according to claim 1, wherein the control stage is operable to start the electric motor and the control time window begins at a start time when the control stage starts the electric motor.

3. A compressor control device according to claim 2, wherein the control stage comprises:

a stall detector module for detecting a stall condition of the compressor, in response to the minimum temperature increment being detected by the temperature sensor within the control time window; and a driving control module, for selectively preventing the driving circuit from supplying the coil, in response to detection of the stall condition.

4. A compressor control device according to claim 3, wherein the stall detector module is configured to provide a compressor stall signal and to switch the compressor stall signal to a stall value, indicative of a compressor stall condition, in response to the minimum temperature increment being detected by the temperature sensor within the control time window.

5. A compressor control device according to claim 4, wherein the stall detector module comprises:

a first memory element, for storing a start value, correlated to a temperature start value of the temperature at the start time;

a second memory element, for storing an increment value correlated to the minimum temperature increment;

a comparator circuit coupled to the first memory element and to the second memory element for providing the compressor stall signal and configured to switch when a current value of the temperature exceeds the temperature start value by the minimum temperature increment.

6. A compressor control device according to claim 5, wherein the stall detector module comprises an enable module for selectively enabling the comparator circuit during the control time window.

7. A compressor control device according to claim 3, wherein the stall detector module is configured to calculate a derivative of the temperature.

8. A device according to claim 1, comprising a voltage supply line, wherein the driving circuit comprises a switching element, for selectively connecting the voltage supply line to the coil, and wherein the temperature sensor is thermally coupled to the switching element.

9. A device according to claim 8, wherein the temperature sensor comprises a thermistor.

10. A device according to claim 8, wherein the temperature sensor comprises a reverse-biased diode.

11. A device according to claim 8, wherein the switching element comprises a thyristor.

12. An appliance comprising a compressor, having a rotor and an electric motor with at least a coil for driving the rotor, and a compressor control device according to claim 1.

13. A circuit for identifying stall of a compressor, the circuit comprising:

a first memory element that stores a starting temperature value associated with a compressor control circuit at a starting time, when the compressor is started;

a second memory element that stores a temperature change value that corresponds to a temperature change associated with a stall of the compressor;

an adder that sums the starting temperature value and the temperature change value to define a stall identification temperature value; and a comparator that compares the stall identification temperature value to a temperature value of the compressor control circuit to identify stall of the compressor.

14. The circuit according to claim 13, further comprising:

a counter that, upon starting of the compressor, enables the circuit to identify stall.

15. The circuit according to claim 14, wherein the counter enables the circuit to identify stall for a predetermined time after starting of the compressor.

16. A circuit for identifying stall of a compressor, the circuit comprising:

a driving circuit that provides an electric motor of the compressor with operating power;

a counter that counts a pre-determined control time window after starting of the compressor;

a temperature sensor that receives a temperature signal correlated to a temperature in the driving circuit;

a stall detecting circuit that determines a time derivative of the temperature signal, and that indicates a stall when the time derivative of the temperature signal exceeds a threshold value within the pre-determined control time window.

* * * * *